US010196247B2

(12) United States Patent
Hiekata et al.

(10) Patent No.: US 10,196,247 B2
(45) Date of Patent: Feb. 5, 2019

(54) ELECTRIC WINCH DEVICE

(71) Applicants: Kobe Steel, Ltd., Kobe-shi (JP); KOBELCO CONSTRUCTION MACHINERY CO., LTD., Hiroshima-shi (JP)

(72) Inventors: Takashi Hiekata, Kobe (JP); Hiroaki Kawai, Kobe (JP); Toshiro Yamashita, Hyogo (JP); Shintaro Sasai, Hyogo (JP); Naoto Hori, Hyogo (JP); Koichi Shimomura, Hyogo (JP)

(73) Assignees: KABUSHIKI KAISHA KOBE SEIKO SHO (KOBE STEEL, LTD.), Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 180 days.

(21) Appl. No.: 15/037,604

(22) PCT Filed: Nov. 6, 2014

(86) PCT No.: PCT/JP2014/079467
§ 371 (c)(1),
(2) Date: May 18, 2016

(87) PCT Pub. No.: WO2015/076116
PCT Pub. Date: May 28, 2015

(65) Prior Publication Data

US 2016/0289054 A1 Oct. 6, 2016

(30) Foreign Application Priority Data

Nov. 20, 2013 (JP) ..... 2013-239849

(51) Int. Cl.

| | |
|---|---|
| ***B66D 1/12*** | (2006.01) |
| ***B66D 5/30*** | (2006.01) |
| ***B66D 1/46*** | (2006.01) |
| ***B66C 13/28*** | (2006.01) |

(52) U.S. Cl.
CPC ..... *B66D 1/46* (2013.01); *B66C 13/28* (2013.01); *B66D 1/12* (2013.01); *B66D 5/30* (2013.01)

(58) Field of Classification Search
CPC .... B66D 1/46; B66D 5/30; B66D 1/12; B66C 13/28
See application file for complete search history.

(56) References Cited

U.S. PATENT DOCUMENTS 4,995,478 A * 2/1991 Oshima ..... B66B 1/28 187/292
5,120,023 A * 6/1992 Kawabata ..... B66B 1/32 187/254

(Continued)

FOREIGN PATENT DOCUMENTS

JP 59-124690 A 7/1984
JP 61-162493 A 7/1986

(Continued)

OTHER PUBLICATIONS

International Search Report dated Feb. 17, 2015 for PCT/JP2014/079467 filed on Nov. 6, 2014.

*Primary Examiner* — Sang K Kim
*Assistant Examiner* — Nathaniel L Adams
(74) *Attorney, Agent, or Firm* — Oblon, McClelland, Maier & Neustadt, L.L.P.

(57) ABSTRACT

Provided is an electric winch device including: an electric motor; a winch drum; a brake; an operation lever; and a controller. The controller includes: a first torque derivation unit which derives a value of a first torque applied to the winch drum due to a load of an object; a second torque derivation unit which derives a value of a second torque generated in the winch drum by a drive torque of the electric motor; and a brake control unit which determines a timing for releasing a braking action on the winch drum after the (Continued)

operation lever has been operated, on the basis of a differential between the second torque value and the first torque value, and which causes the brake to release the braking action on the winch drum by transmitting, to the brake, a control signal instructing release of the braking action on the winch drum at the determined timing.

5 Claims, 10 Drawing Sheets

(56) References Cited

U.S. PATENT DOCUMENTS

| | | | | |
|---|---|---|---|---|
| 6,644,629 | B1 * | 11/2003 | Higashi | B66D 1/48 254/361 |
| 8,167,154 | B2 * | 5/2012 | Heidrich | B66D 1/44 212/284 |
| 2002/0033481 | A1 | 3/2002 | Kemppainen | |
| 2011/0303493 | A1 * | 12/2011 | Hubbard | B66D 5/14 187/254 |
| 2011/0303886 | A1 * | 12/2011 | Cryer | B66D 1/22 254/340 |

FOREIGN PATENT DOCUMENTS

| | | | |
|---|---|---|---|
| JP | 62-218390 | A | 9/1987 |
| JP | 63-185798 | A | 8/1988 |
| JP | 11-278795 | A | 10/1999 |
| JP | 2000-351585 | A | 12/2000 |
| JP | 2003-054878 | A | 2/2003 |
| WO | 2011/120393 | A1 | 10/2011 |

* cited by examiner

ELECTRIC WINCH DEVICE

TECHNICAL FIELD

The present invention relates to an electric winch device which is used in a crane.

BACKGROUND ART

A crane is conventionally provided with a winch device for performing hoisting operations (crane operations). A winch device is provided with a winch drum that rotates by being driven by a motor, and performs hoisting or lowering of an object by means of this winch drum. The hoisting or lowering of the object is instructed by an operator operating an operation lever. In the winch device, the motor performs hoisting or lowering of the object by causing the winch drum to rotate in a hoisting direction or lowering direction, in accordance with the operation of the operation lever.

Furthermore, the winch device is provided with a negative brake. The negative brake holds the winch drum so that the winch drum cannot rotate by applying a braking action to the winch drum, when the operation lever is disposed in a neutral position, and releases the braking action applied to the winch drum when the operation lever is operated from the neutral position. However, in a winch device of this kind, there is a possibility that the timing at which the negative brake releases the braking action applied to the winch drum may diverge from the timing at which the motor starts rotation of the winch drum. If the timing of the release of the braking action applied to the winch drum is earlier than the timing of the start of rotation of the winch drum, then a slipping-down phenomenon occurs in which the object drops momentarily. If the timing of the release of the braking action applied to the winch drum is later than the timing of the start of rotation of the winch drum, then a pull-up effect occurs in which the winch drum performs a hoisting operation of the object while the braking action is still applied to the winch drum by the brake.

The following Patent Documents disclose technology for preventing the occurrence of phenomena such as the foregoing.

Patent Document 1 describes a winch braking device provided with a pilot valve that generates a pilot pressure corresponding to the operation of an operation lever from a hydraulic pressure supplied from a pilot hydraulic pressure pump, a direction control valve that controls the direction of rotation of a hydraulic motor in accordance with the generated pilot pressure, and a hydraulic brake which applies a braking action to the winch drum. A switching valve and a brake value are arranged in series between the pilot hydraulic pressure pump and the hydraulic brake. The switching valve is switched to a state for supplying hydraulic pressure from the pilot hydraulic pressure pump to the brake valve, by the pilot pressure generated by the pilot valve in accordance with the operation of the operation lever. The brake valve is switched to a state of supplying hydraulic pressure from the switching valve to the hydraulic brake in accordance with hydraulic pressure supplied from the direction control valve to the hydraulic motor. The hydraulic brake applies a braking action to the winch drum when no hydraulic pressure is supplied from the brake valve, and releases the braking action on the winch drum when hydraulic pressure is supplied from the brake valve. Consequently, when the hydraulic motor starts rotation of the winch drum due to hydraulic pressure being supplied from the direction switching valve to the hydraulic motor, then the braking action of the hydraulic brake on the winch drum is released simultaneously due to hydraulic pressure being supplied from the brake valve to the hydraulic brake. As a result of this, the slipping-down phenomenon and the pull-up phenomenon described above are prevented.

Furthermore, in Patent Document 2, a counterbalance valve is provided in the piping that supplies hydraulic pressure to the hydraulic motor. A pressure sensor for detecting the holding pressure inside the piping is provided in the piping between the counterbalance valve and the hydraulic motor. When the operation lever is in the neutral position, a braking action is applied to the winch drum by the brake device. When the operation lever is operated to the hoisting side, then the brake device is controlled so as to gradually reduce the braking force on the winch drum, until the holding pressure detected by the pressure sensor reaches a target holding pressure required in order to hold the suspended load. Therefore, sudden release of the holding of the suspended load, and the subsequent occurrence of a slipping-down phenomenon, is prevented. Furthermore, when the holding pressure detected by the pressure sensor has risen to the target holding pressure, then the brake device is controlled in such a manner that the braking force on the winch drum immediately becomes zero. Therefore, the occurrence of a pull-up phenomenon of the brake is prevented.

In recent years, there have been demands for electrification of winch devices used in cranes. In an electric winch device, a winch drum is caused to rotate by using an electric motor instead of a hydraulic motor, and an object is hoisted by the winch drum, but an electric winch device of this kind also has the problems of slipping-down and pull-up phenomena described above. However, in order to prevent the occurrence of these phenomena in an electric winch device, it is difficult to apply the technologies disclosed in the Patent Documents indicated above. More specifically, the technologies in the Patent Documents indicated above use hydraulic pressure which is supplied to a hydraulic motor in order to control a brake releasing operation, and cannot be applied to an electric winch device which does not have hydraulic pressure of this kind.

CITATION LIST

Patent Literature

Patent Document 1: Japanese Patent Application Publication No. 2000-351585

Patent Document 2: Japanese Patent Application Publication No. H11-278795

SUMMARY OF INVENTION

The object of the present invention is to provide an electric winch device, in which it is possible to prevent the occurrence of a slipping-down phenomenon of the object or a pull-up phenomenon of the brake, at the start of hoisting or lowering of the object.

The electric winch device according to one aspect of the present invention is an electric winch device provided on a crane, the electric winch device including: an electric motor; a winch drum which rotates so as to hoist or lower an object by being driven by the electric motor; a brake which brakes the rotation of the winch drum; an operation lever which is capable of being operated from a neutral position to a hoisting side and to a lowering side, the hoisting side being one side for instructing hoisting of the object, the lowering side being the other side for instructing lowering of the object; an ammeter which measures a value of a current supplied to the electric motor; and a controller which controls the operation of the electric motor so that the winch drum rotates in accordance with the operation of the operation lever, and also controls the operation of the brake, wherein the controller includes: a first torque derivation unit which derives a value of a first torque applied to the winch drum due to the load of the object; a second torque derivation unit which derives a value of a second torque on the basis of the current value measured by the ammeter, the second torque being a torque generated in the winch drum in the direction of rotation for hoisting the object by a drive torque of the electric motor; and a brake control unit which determines a timing for releasing a braking action on the winch drum after the operation lever has been operated to the hoisting side or the lowering side from the neutral position, on the basis of a differential between the second torque value derived by the second torque derivation unit and the first torque value derived by the first torque derivation unit, and which causes the brake to release the braking action on the winch drum by transmitting, to the brake, a control signal instructing release of the braking action on the winch drum at the determined timing.

DESCRIPTION OF EMBODIMENTS

Embodiments of this invention are described below with reference to the drawings.

Firstly, an electric winch device according to one embodiment of the present invention will be described with reference to FIG. 1 and FIG. 2.

The electric winch device according to the present embodiment is provided in a crane and is used as a suspended load winch device, which performs hoisting and lowering of a suspended load 100. A crane in which this electric winch device is provided is equipped with a boom 2 (see FIG. 1) that is provided so as to perform a derricking motion with respect to a crane main body, which is not illustrated. A hook device 6 is suspended from the front end of the boom 2 via a suspension rope 4, which is a wire rope, and the load 100 is suspended from this hook device 6. The electric winch device is installed in the crane main body (not illustrated) and hoists or lowers the hook device 6, and the suspended load 100 which is suspended from the hook device 6, via the suspension rope 4.

Below, the specific configuration of the electric winch device according to the present embodiment will be described.

Figure 1:
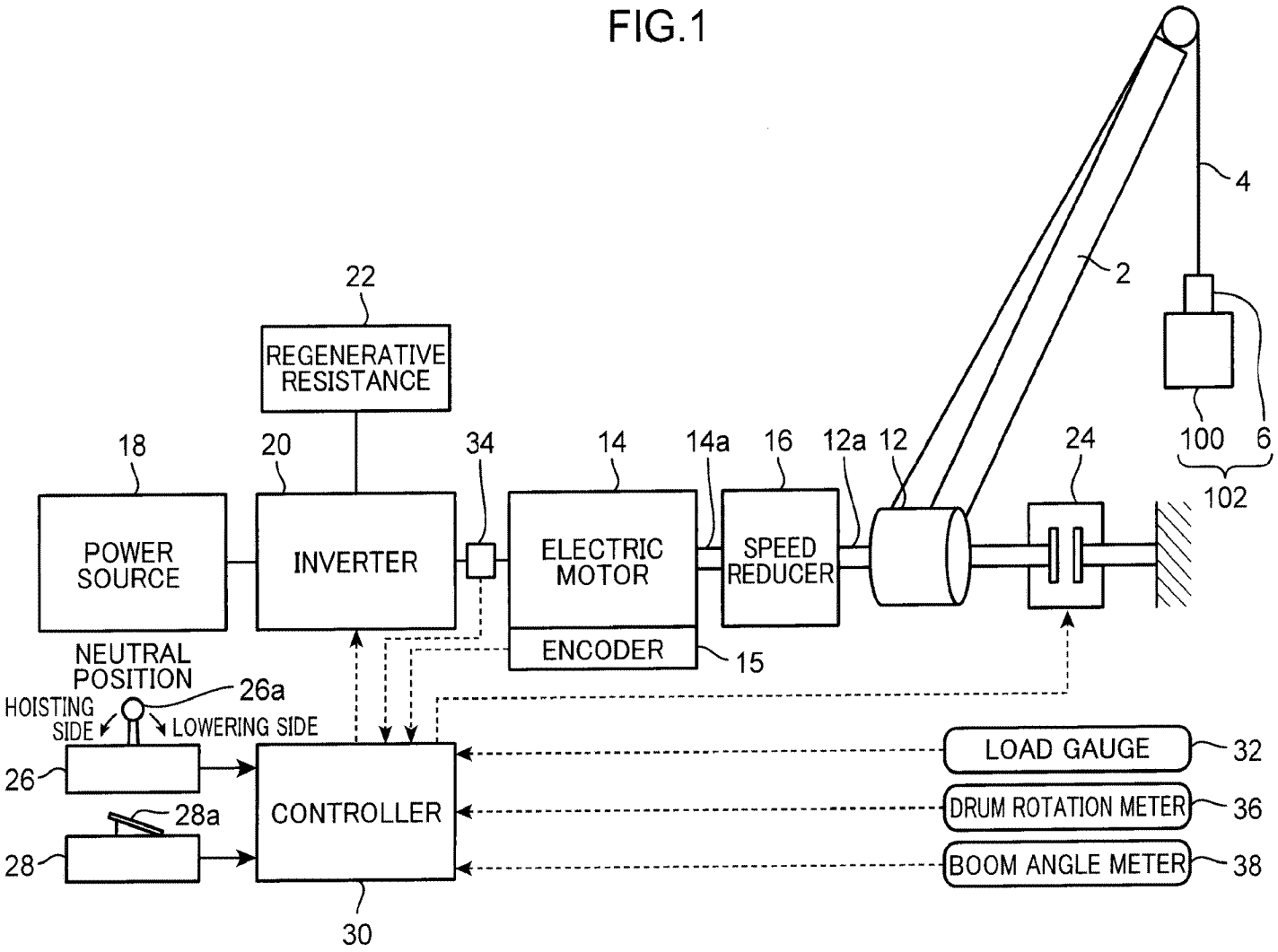
FIG. 1 is a schematic drawing of the configuration of the electric winch device according to one embodiment of the present invention.

As shown in FIG. 1, the electric winch device of the present embodiment includes a drum 12, an electric motor 14, a speed reducer 16, a power source 18, an inverter 20, a regenerative resistance 22, a brake 24, an operation lever device 26, a brake pedal device 28, a controller 30, a load gauge 32, an ammeter 34, a drum rotation meter 36 and a boom angle meter 38.

The drum 12 is a winch drum which is driven by the electric motor 14 so as to rotate in order to hoist or lower the hook device 6 and the load 100 suspended therefrom. Below, the hook device 6 and the load 100 suspended therefrom are referred to jointly as a hoisting/lowering object 102. The drum 12 winds the suspension rope 4, and thus winds up the object 102, by rotating in a hoisting direction, which is one direction of rotation. Furthermore, the drum 12 pays out the suspension rope 4, and thus lowers the object 102, by rotating in a lowering direction, which is the opposite direction of rotation to the hoisting direction.

The electric motor 14 operates due to receiving a supply of power, and causes the drum 12 to rotate in the hoisting direction. The electric motor 14 functions as a power generator when lowering the object 102, in other words, when the drum 12 rotates in the lowering direction. A drive shaft 14*a* of the electric motor 14 is coupled to a rotary shaft 12*a* of the drum 12 via the speed reducer 16. When hoisting the object 102, the drive torque of the electric motor 14 is transmitted to the drum 12 from the drive shaft 14*a*, via the speed reducer 16 and the rotary shaft 12*a*, so that the drum 12 is rotated in the hoisting direction. When lowering the object 102, the rotational force of the drum 12 in the lowering direction is transmitted from the rotary shaft 12*a* to the electric motor 14 via the speed reducer 16 and the drive shaft 14*a*, so that power is generated in the electric motor 14. The speed reducer 16 decelerates the rotation of the drive shaft 14*a* of the electric motor 14 by a predetermined speed reduction ratio, and transmits the rotation to the rotary shaft 12*a* of the drum 12.

Furthermore, an encoder 15 which detects the number of revolutions (rotational speed) and the amount of rotation of the electric motor 14 is appended to the electric motor 14. The encoder 15 sends data about the number of revolutions and the amount of rotation of the electric motor 14 thus detected, to the controller 30.

The power source 18 is connected electrically to the electric motor 14 via the inverter 20. The power source 18 supplies power to the electric motor 14 via the inverter 20. The battery installed in the crane, or an external power source, etc., is used for the power source 18. When an external power source is used for the power source 18, plug-in terminals are provided on the crane main body in order to connect with connection terminals of the external power source.

The inverter 20 controls the operation of the electric motor 14 in accordance with the commands from the controller 30. More specifically, the inverter 20 controls the number of revolutions and amount of rotation of the electric motor 14 by changing the current value supplied to the electric motor 14 in accordance with commands from the controller 30, thereby controlling the hoisting speed and hoisting amount of the object 102.

The regenerative resistance 22 is electrically connected to the inverter 20. The regenerative resistance 22 is a resistance for consuming and adjusting the power that cannot be absorbed completely by the power source 18, of the power that is regenerated (generated) by the electric motor 14 when the object 102 is lowered.

The brake 24 applies a braking action to the drum 12 so as to prevent rotation of the drum 12 in the hoisting direction or the lowering direction. In the present embodiment, a dry brake is used as the brake 24. This brake 24 switches between a braking state for halting the rotation of the drum 12 by applying a braking action to the drum 12, and a released state for releasing the braking action on the drum 12, in accordance with a brake control signal from the controller 30.

The operation lever device 26 is used by an operator in order to instruct a hoisting/lowering operation of the object 102 by the electric winch device. The operation lever device 26 is provided with a lever 26*a* which is operated by the operator in order to instruct rotation of the drum 12 in the hoisting direction, rotation thereof in the lowering direction, or a halt of rotation. The lever 26*a* is configured to be capable of being operated between a hoisting side, which is on one side of a neutral position, and a lowering side, which is on the opposite side of the neutral position from the hoisting side. The neutral position corresponds to a position for instructing a halt of rotation of the drum 12. The hosting side is the operating direction of the lever 26*a* in order to instruct rotation of the drum 12 in the hoisting direction of the object 102. The lowering side is the operating direction of the lever 26*a* in order to instruct rotation of the drum 12 in the lowering direction of the object 102. The operation lever device 26 outputs information indicating the operating direction of the lever 26*a* and the amount of operation thereof from the neutral position, to the controller 30. More specifically, the operation lever device 26 outputs information indicating an operation amount of zero of the lever 26*a*, to the controller 30, when the lever 26*a* is in the neutral position. The operation lever device 26 outputs information indicating the operation amount of the lever 26*a* from the neutral position, as a positive value, to the controller 30, when the lever 26*a* is operated to the hoisting side from the neutral position. Furthermore, the operation lever device 26 outputs information indicating the operation amount of the lever 26*a* from the neutral position, as a negative value, to the controller 30, when the lever 26*a* is operated to the lowering side from the neutral position.

A brake pedal device 28 is used by the operator to switch the brake 24 between the braking state and the released state, as desired. The brake pedal device 28 is provided with a pedal 28*a* which is operated by the operator in order to switch the brake 24 between the braking state and the released state. The brake pedal device 28 outputs a signal indicating a pressed state or a released state of the pedal 28*a*, to the controller 30. The released state of the pedal 28*a* corresponds to a state instructing the brake 24 to be set to the braking state. The pressed state of the pedal 28*a* corresponds to a state instructing the brake 24 to be set to the released state. In the electric winch device of the present embodiment, apart from a normal operation mode in which switching of the brake 24 is controlled automatically in accordance with a lowering torque and a hoisting torque of the drum 12, which are described hereinafter, it is also possible to select a free-fall mode in which the operator can switch between the braking state and the released state of the brake 24, as desired. The brake pedal device 28 is used when the free-fall mode is selected. In other words, when the switching of the brake 24 is controlled automatically in accordance with the lowering torque and hoisting torque of the drum 12, any operation of the pedal 28*a* in the brake pedal device 28 will be invalid.

The controller 30 controls the operation of the electric motor 14 so that the drum 12 rotates in accordance with the operation of the lever 26*a*. Furthermore, the controller 30 controls the operation of the brake 24. More specifically, the controller 30 controls the switching operation between the braking state and the released state of the brake 24. The controller 30 operates the electric motor 14 in such a manner that the electric motor 14 causes the drum 12 to rotate according to the input information, in accordance with the input of information indicating the operating direction and operation amount of the lever 26*a* from the operation lever device 26. The controller 30 controls the inverter 20 in such a manner that a current which causes the electric motor 14 to perform such an operation is supplied from the inverter 20 to the electric motor 14. The controller 30 controls the inverter 20 by sending a gate control signal to the inverter 20. Furthermore, the controller 30 sends a brake control signal which instructs switching to the braking state, to the brake 24, when the brake 24 is switched from the released state to the braking state. The controller 30 sends a brake control signal instructing switching to the released state, to the brake 24, when the brake 24 is switched from the braking state to the released state. When the normal operation mode is selected, the controller 30 controls the switching of the brake 24 automatically in accordance with the lowering torque and the hoisting torque of the drum 12, which is described hereinafter. On the other hand, when the free-fall mode is selected, the controller 30 controls switching of the brake 24 in accordance with a signal indicating the state of operation of the pedal 28*a* from the brake pedal device 28. The configuration for automatically controlling the switching of the brake 42 in the normal operation mode is explained below, and the detailed configuration of the controller 30 is described further below.

The load gauge 32 detects the load applied to the drum 12 via the suspension rope 4, as a value of the external force applied to the drum 12 due to the load of the object 102. More specifically, the load gauge 32 detects the tension in the suspension rope 4. The load gauge 32 successively detects the tension in the suspension rope 4 and successively outputs the detected tension data to the controller 30.

The ammeter 34 is provided in the electric wiring between the inverter 20 and the electric motor 14. The ammeter 34 measures the value of the current flowing between the inverter 20 and the electric motor 14. The ammeter 34 successively measures the value of the current flowing between the inverter 20 and the electric motor 14, and successively outputs the measured current value data to the controller 30.

The drum rotation meter 36 detects the number of revolutions per unit time of the drum 12. The drum rotation meter 36 successively detects the number of revolutions of the drum 12 and successively outputs the detected number of revolutions data to the controller 30.

The boom angle meter 38 detects the derricking angle of the boom 2. The boom angle meter 38 successively detects the derricking angle of the boom 2 and outputs the detected derricking angle data to the controller 30.

Next, the internal configuration of the controller 30 will be described.

Figure 2:
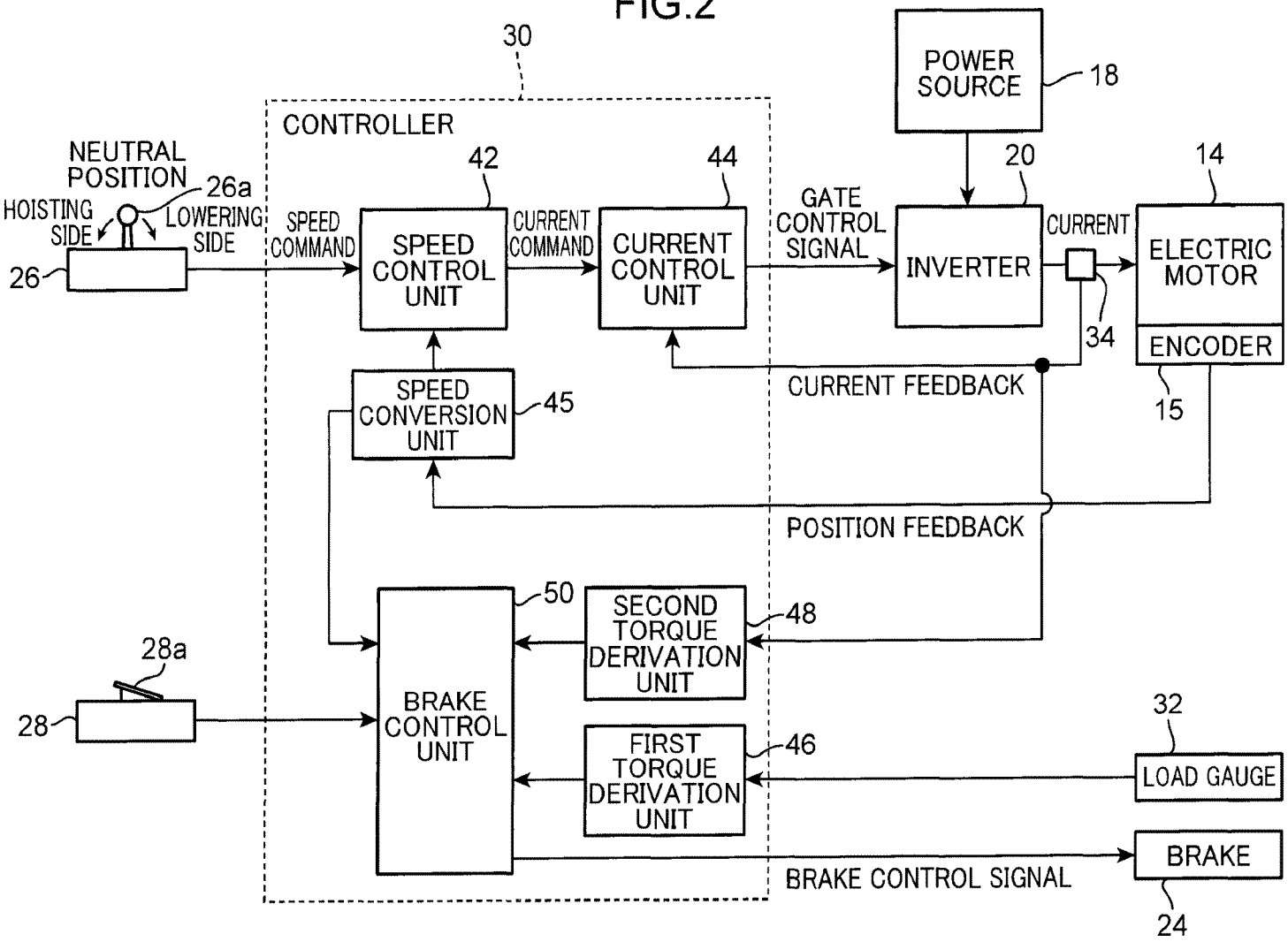
FIG. 2 is a functional block diagram showing the detailed configuration of a controller of the electric winch device shown in FIG. 1.
Figure 3:
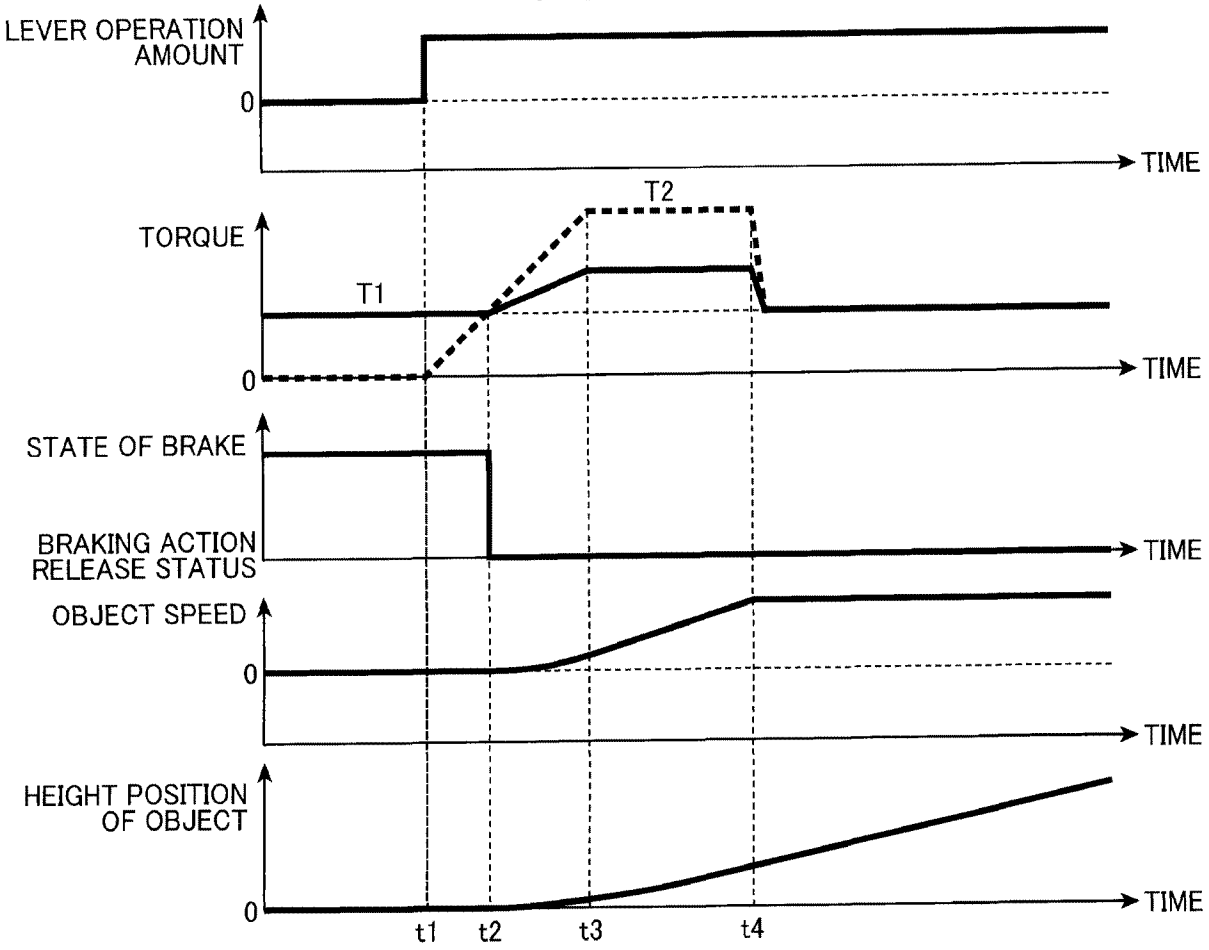
FIG. 3 is a diagram showing change over time in the lever operation amount, the lowering torque and hoisting torque of the drum, the state of the brake, the vertical speed of the object, and the height position of the object, during the course of hoisting an object from a stopped state in the electric winch device.
Figure 4:
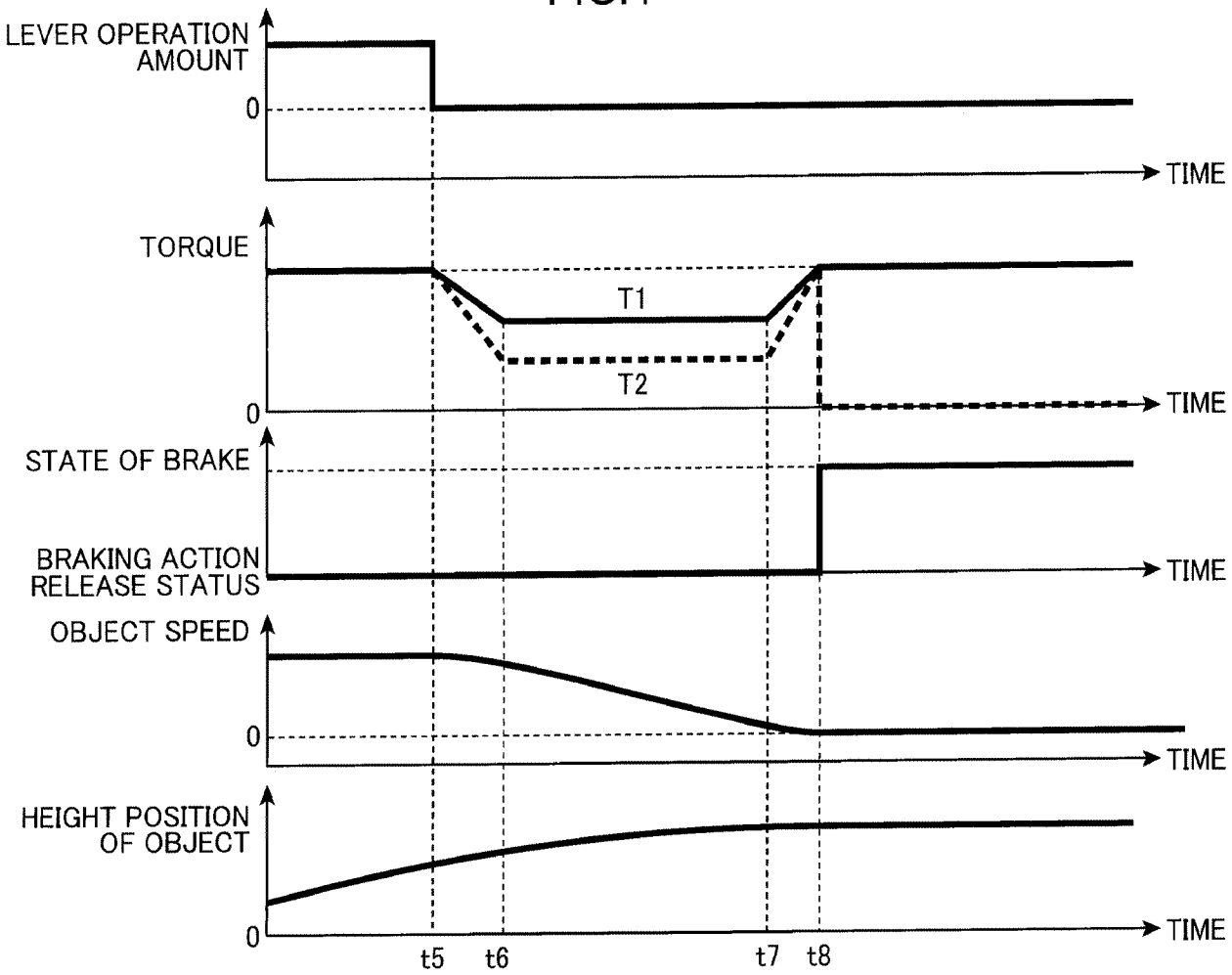
FIG. 4 is a diagram showing change over time in the lever operation amount, the lowering torque and hoisting torque of the drum, the state of the brake, the vertical speed of the object, and the height position of the object, during the course of stopping an object from a state of being hoisted in the electric winch device.
Figure 5:
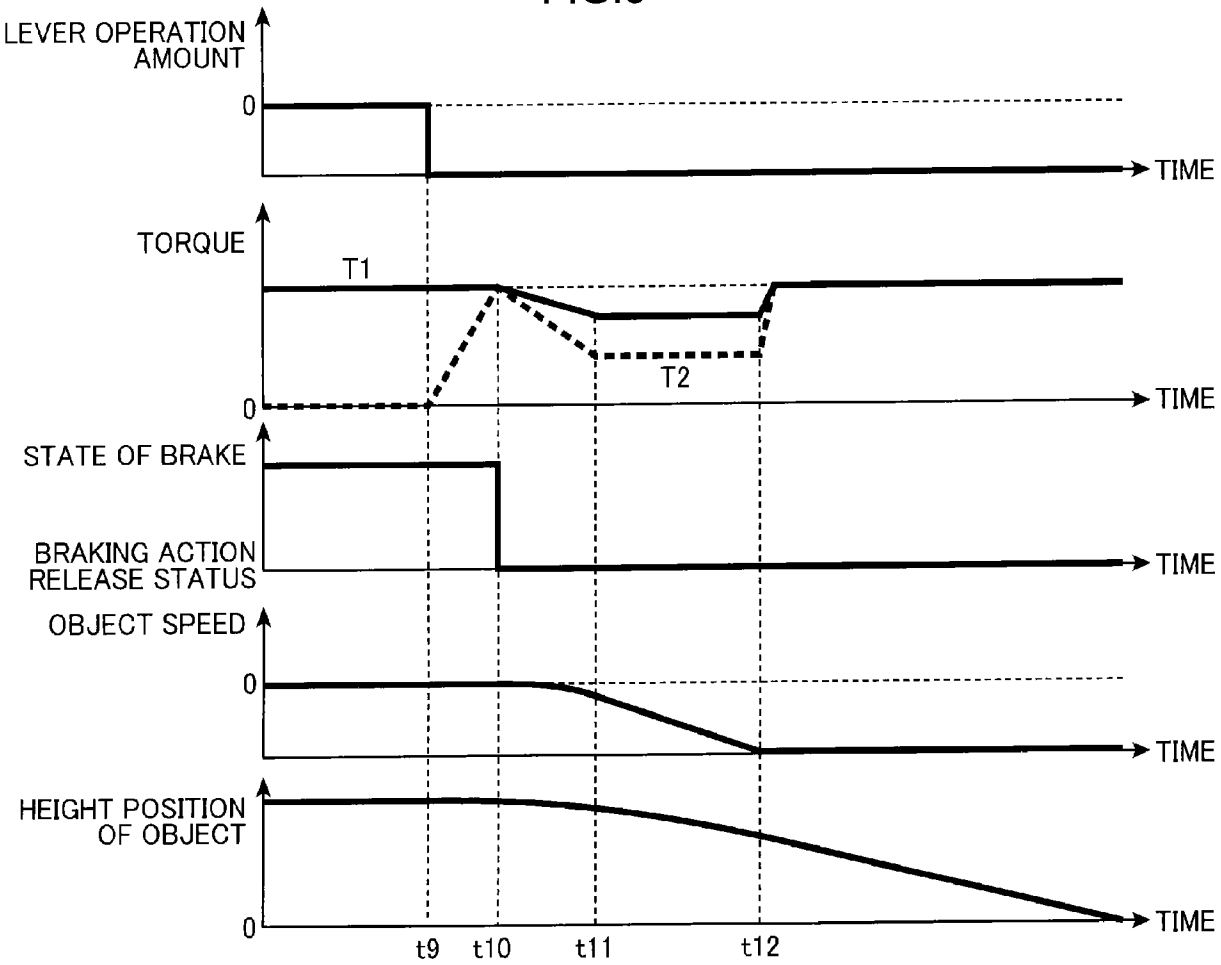
FIG. 5 is a diagram showing change over time in the lever operation amount, the lowering torque and hoisting torque of the drum, the state of the brake, the vertical speed of the object, and the height position of the object, during the course of lowering an object from a stopped state in the electric winch device.
Figure 6:
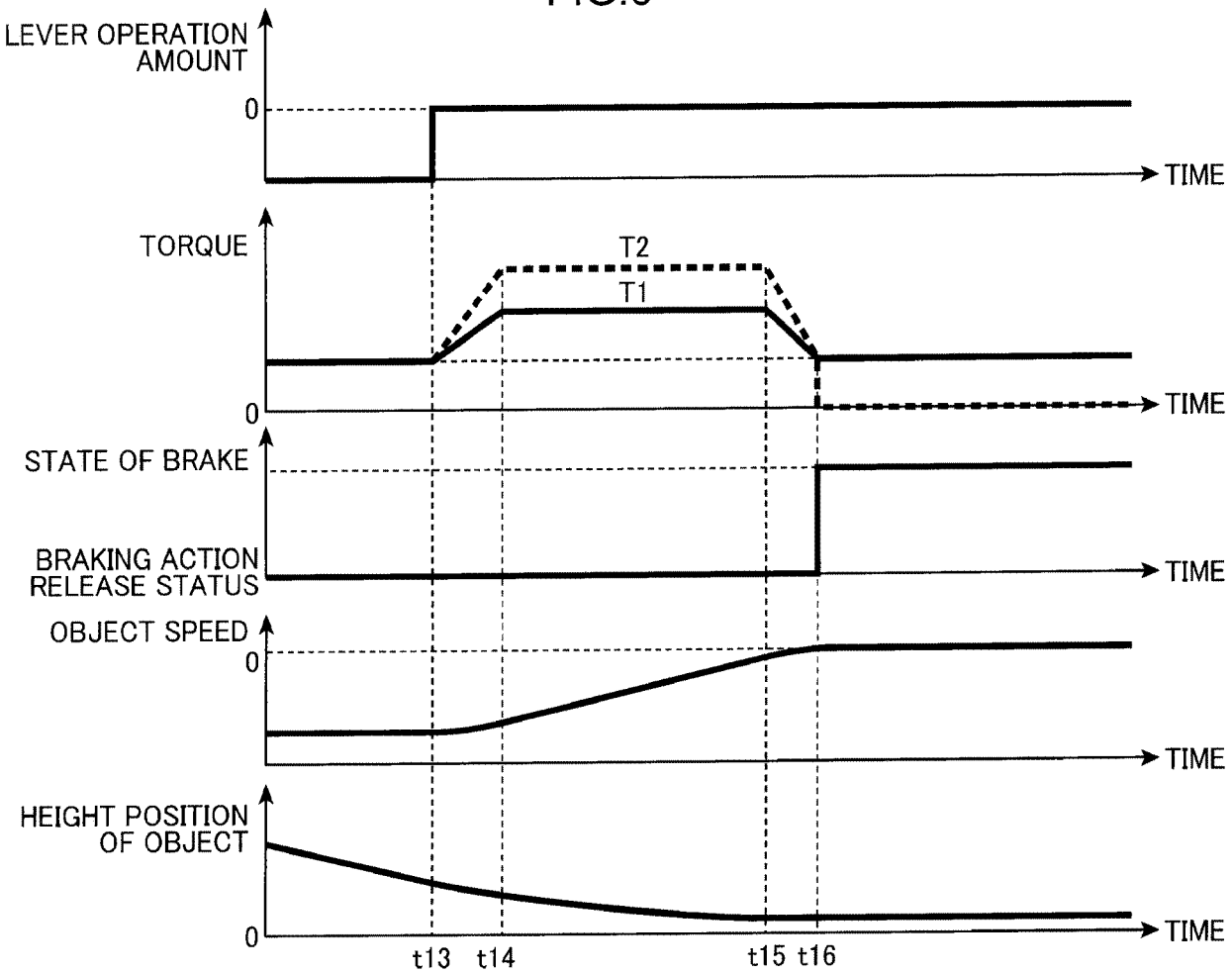
FIG. 6 is a diagram showing change over time in the lever operation amount, the lowering torque and hoisting torque of the drum, the state of the brake, the vertical speed of the object, and the height position of the object, during the course of stopping an object from a state of being lowered in the electric winch device.

As shown in FIG. 2, the controller 30 includes the following functional blocks: a speed control unit 42, a current control unit 44, a speed conversion unit 45, a first torque derivation unit 46, a second torque derivation unit 48 and a brake control unit 50.

A speed command including information about the operating direction and the operation amount of the lever 26*a* is input to the speed control unit 42 from the operation lever device 26. Furthermore, rotation position information of the electric motor 14 is input to the speed conversion unit 45 from the encoder 15. The speed conversion unit 45 converts the input rotation position information to a rotational speed of the electric motor 14, and inputs the converted rotational speed to the speed control unit 42. The speed control unit 42 outputs a current command including a current value required in order to change the rotational speed of the electric motor 14 obtained from the speed conversion unit 45 to a speed corresponding to the speed command from the operation lever device 26.

Data on the current value supplied to the electric motor 14 as detected by the ammeter 34 is input to the current control unit 44. The current control unit 44 compares the current value instructed by the current command input from the speed control unit 42, with the current value data input from the ammeter 34, and outputs a gate control signal instructing the inverter 20 to change the current value presently supplied to the electric motor 14, to a current value corresponding to the current command.

The first torque derivation unit 46 derives the value of the torque applied to the drum 12 due to the load of the object 102. The torque applied to the drum 12 due to the load of the object 102 is applied to the drum 12 in the direction of rotation for lowering the object 102, and therefore this torque is called "lowering torque" below. This lowering torque is included in the concept of "first torque" in the present invention. The first torque derivation unit 46 receives input of tension data detected by the load gauge 32, in other words, data about the tension occurring in the suspension rope 4 due to the load of the object 102. The first torque derivation unit 46 calculates the value of the lowering torque applied to the drum 12, at very small time intervals apart (for example, every several msec to every several tens of msec), on the basis of the input tension data.

Data on the current value supplied to the electric motor 14 as measured by the ammeter 34 is input to the second torque derivation unit 48. The second torque derivation unit 48 derives the value of the torque occurring in the hoisting direction in the drum 12, due to the driving torque of the electric motor 14, on the basis of the current value measured by the ammeter 34. The torque generated in the drum 12 in the hoisting direction is called "hoisting torque" below. This hoisting torque is included in the concept of "second torque" in the present invention. The second torque derivation unit 48 calculates the value of the hoisting torque at very small time intervals apart, similarly to the case of the first torque derivation unit 46 calculating the value of the lowering torque.

The brake control unit 50 controls the operation of the brake 24, and more specifically, controls the switching operation of the brake 24 between the braking state for applying a braking action to the drum 12 and the released state for releasing the braking action on the drum 12. The brake control unit 50 receives input of the lowering torque value calculated by the first torque derivation unit 46 and the hoisting torque value calculated by the second torque derivation unit 48, each time these values are calculated. The brake control unit 50 determines the timing at which a braking action is to be applied to the drum 12 and the timing at which the braking action on the drum 12 is to be released, on the basis of the differential between the lowering torque value calculated by the first torque derivation unit 46 and the hoisting torque value calculated by the second torque derivation unit 48.

More specifically, the brake control unit 50 calculates the differential between the input hoisting torque value and the lowering torque value, whenever a lowering torque value is input from the first torque derivation unit 46 and a hoisting torque value is input from the second torque derivation unit 48, in other words, at the very small time intervals apart indicated above, and successively monitors the value of the calculated differential. In the present embodiment, the brake control unit 50 sets the timing at which the braking action on the drum 12 is released as the timing at which the differential between the input hoisting torque value and lowering torque value becomes zero (first specific value), after the lever 26*a* has been operated to the hoisting side or the lowering side from the neutral position. Furthermore, the brake control unit 50 sets the timing at which a braking action is to be applied to the drum 12 as the timing at which the differential between the input hoisting torque value and lowering torque value becomes zero (second specific value), after the lever 26*a* has been returned to the neutral position from a state of having been operated to the hoisting side or the lowering side. The brake control unit 50 causes the brake 24 to apply a braking action to the drum 12 by sending a brake control signal instructing the application of a braking action to the drum 12, to the brake 24, at the determined timing for applying braking action to the drum 12. Furthermore, the brake control unit 50 causes the brake 24 to release the braking action on the drum 12 by sending a brake control signal instructing the release of the braking action on the drum 12, to the brake 24, at the determined timing for releasing the braking action on the drum 12.

Next, the operation of the electric winch device according to the present embodiment will be described. More specifically, the operation of the electric winch device in a procedure for hoisting the object 102 from a halted state, and then stopping the hoisting action, and subsequently lowering the object 102 and stopping the lowering action, will be described.

FIG. 3 to FIG. 6 show the changes in the operation amount of the lever 26*a*, the lowering torque T1 applied to the drum 12, the hoisting torque T2 generated in the drum 12, the state of the brake 24, the speed of the object 102 in the vertical direction, and the height position of the object 102, with the passage of time while said operation is performed. In these diagrams, a state where the operation amount of the lever 26*a* is zero indicates that the lever 26*a* is in a neutral position, a state where the operation amount of the lever 26*a* has increased to the positive side (upper side) from zero indicates that the lever 26*a* has been operated to the hoisting side from the neutral position, and a state where the operation amount of the lever 26*a* has decreased to the negative side (lower side) from zero indicates that the lever 26*a* has been operated to the lowering side from the neutral position. Furthermore, a state where the speed of the object 102 is zero indicates that the object 102 is stopped, a state where the speed of the object 102 has increased to the positive side (upper side) from zero indicates that the object 102 has accelerated and is being hoisted, and a state where the speed of the object 102 has decreased to the negative side (lower side) from zero indicates that the object 102 has accelerated and is being lowered.

When the object 102 is in a stopped state, (during the time period 0 to t1 in FIG. 3), the lever 26*a* is in the neutral position. In this case, the brake 24 is set to the braking state in which the brake 24 applies a braking action to the drum 12 so that the object 102 does not slip down, in other words, the braking state in which the brake 24 applies a braking action to the drum 12 so that the drum 12 does not rotate.

When the lever 26*a* is operated to the hoisting side from the neutral position at time t1, a speed command corresponding to the operation amount from the neutral position of the lever 26*a* is input to the speed control unit 42 of the controller 30 from the operation lever device 26. The speed control unit 42 outputs a current command corresponding to the input speed command, to the current control unit 44, and the current control unit 44 outputs a gate control signal corresponding to the input current command, to the inverter 20. The inverter 20 supplies a current corresponding to the input gate control signal, to the electric motor 14. In this way, the controller 30 causes the inverter 20 to control the current supplied to the electric motor 14 in such a manner that the electric motor 14 operates at a rotational speed corresponding to the operation amount of the lever 26*a*. When the object 102 is stopped from a state of being hoisted, or when the object 102 in a stopped state is lowered, or when the object 102 is stopped from a state of being lowered, as described below, a process corresponding to this process from the operation of the lever 26*a* to the control of current supplied to the electric motor 14 is carried out.

The electric motor 14 operates by receiving supply of current from the inverter 20 so as to output drive torque corresponding to the supplied current. The drive torque of the electric motor 14 is transmitted from the drive shaft 14*a* to the rotary shaft 12*a* of the drum 12 via the speed reducer 16.

The first torque derivation unit 46 repeatedly calculates the value of the lowering torque T1 applied to the drum 12 due to the load of the object 102, at the predetermined very small time intervals apart, on the basis of the value of the tension in the suspension rope 4 detected by the load gauge 32, the weight of the object 102, and the diameter of the drum 12.

Furthermore, the second torque derivation unit 48 repeatedly calculates the value of the hoisting torque T2 generated in the drum 12 due to the transmission of drive torque from the electric motor 14, at the predetermined very small time intervals apart, from the value of the current supplied to the electric motor 14 which is measured by the ammeter 34. More specifically, a hoisting torque T2 which is reduced by a certain amount from the drive torque of the electric motor 14 due to the speed reduction ratio of the speed reducer 16, and the mechanical frictional resistance of the speed reducer 16, etc. is generated in the drum 12. Therefore, the second torque derivation unit 48 calculates the drive torque of the electric motor 14 on the basis of the current value data input from the ammeter 34, and al so calculates the value of the hoisting torque T2 generated in the drum 12 by subtracting, from this calculated drive torque, the reduction in torque caused by the speed reduction ratio of the speed reducer 16 and the mechanical frictional resistance of the speed reducer 16, etc. This calculation of the value of the hoisting torque T2 by the second torque derivation unit 48 and calculation of the value of the lowering torque T1 by the first torque derivation unit 46 is carried out repeatedly during the period of operation of the electric winch device.

Furthermore, the brake control unit 50 calculates the differential Td between the value of the hoisting torque T2 generated in the drum 12 as calculated by the second torque derivation unit 48, and the value of the lowering torque T1 applied to the drum 12 as calculated by the first torque derivation unit 46, repeatedly at the predetermined very small time intervals apart. In other words, the brake control unit 50 repeatedly calculates, at the predetermined very small time intervals apart, an absolute value of a value obtained by subtracting the value of the lowering torque T1 calculated by the first torque derivation unit 46 from the value of the hoisting torque T2 calculated by the second torque derivation unit 48. This calculation of the differential Td between the value of the hoisting torque T2 and the value of the lowering torque T1 by the brake control unit 50 is carried out repeatedly during the period of operation of the electric winch device. The brake control unit 50 sends a brake control signal to the brake 24 at the timing (time t2) where the hoisting torque T2 generated in the drum 12 due to the drive torque of the electric motor 14 has increased so that the calculated differential Td has become zero, the brake control signal being a signal instructing the brake 24 to release the braking action on the drum 12. The brake 24 switches from the braking state to the released state in accordance with this brake control signal, and releases the braking action on the drum 12.

When the braking action of the brake 24 on the drum 12 is released, the drum 12 rotates in the hoisting direction to wind up the suspension rope 4, and therefore the object 102 is hoisted up. The hoisting torque T2 generated in the drum 12 increases to a greater extent than the lowering torque T1, and consequently, the object 102 accelerates in the upward direction (time period t2 to t3).

When the hoisting torque T2 generated in the drum 12 reaches a predetermined value, the hoisting torque T2 is maintained uniformly at that predetermined value (time period t3 to t4). Consequently, the hoisting speed of the object 102 increases at a uniform rate. Furthermore, the height position of the object 102 also increases at a corresponding rate.

When a certain time has elapsed and the time reaches time t4, the hoisting torque T2 generated in the drum 12 decreases. Therefore, the object 102 changes from a state of being hoisted while accelerating, to a state of being hoisted at a uniform speed, and in accordance with this, the lowering torque T1 applied to the drum 12 decreases. In this case, the hoisting torque T2 generated in the drum 12 and the lowering torque T1 applied to the drum 12 decrease to a value equal to the lowering torque T1 that was applied to the drum 12 while the object 102 was stopped (time period 0 to t2). Thereupon, the hoisting torque T2 and the lowering torque T1 are kept uniformly at this reduced value.

When the lever 26*a* is subsequently returned to the neutral position at time t5 (see FIG. 4), in accordance with this, the hoisting torque T2 generated in the drum 12 becomes lower than the lowering torque T1 applied to the drum 12. Therefore, the hoisting speed of the object 102 starts to decrease and the rise in the height position of the object 102 becomes more gradual. In this case, the lowering torque T1 applied to the drum 12 is also reduced. The rate of decrease in the lowering torque T1 is smaller than the rate of decrease in the hoisting torque T2.

When the hoisting torque T2 generated in the drum 12 at time t6 has decreased to a predetermined value, the hoisting torque T2 is kept uniformly at this predetermined value. In accordance with this, the hoisting speed of the object 102 decreases at a uniform rate and the rise in the height position of the object 102 becomes even more gradual. In this case, the lowering torque T1 applied to the drum 12 is kept uniformly at a value higher than the hoisting torque T2.

When a certain time has elapsed and the time reaches time t7, the hoisting torque T2 generated in the drum 12 increases. In accordance with this, the decrease in the hoisting speed of the object 102 becomes more gradual. In this case, the lowering torque T1 applied to the drum 12 also increases, but the rate of increase in the lowering torque T1 is small compared to the rate of increase in the hoisting torque T2. The brake control unit 50 then sends a brake control signal to the brake 24 at the timing (time t8) when the calculated differential Td between the value of the hoisting torque T2 and the value of the lowering torque T1 becomes zero, the brake control signal being a signal instructing the brake 24 to apply a braking action to the drum 12. The brake 24 switches from the released state to the braking state in accordance with this brake control signal, and applies a braking action to the drum 12. Consequently, the drum 12 is held so as not to rotate by the braking force of the brake 24. When this braking action is applied, the hoisting speed of the object 102 will have already been reduced to a speed close to zero, and therefore the occurrence of shocks due to the braking action is suppressed. Thereafter, the rise in the height position of the object 102 is stopped and the object 102 is held at this stopped height position.

Next, at time t9 (see FIG. 5), the lever 26*a* is operated to the lowering side from the neutral position. Thereby, the hoisting torque T2 generated in the drum 12 increases from zero, and at time t10, reaches a value equal to the lowering torque T1 applied to the drum 12. The brake control unit 50 then sends a brake control signal to the brake 24 at the timing (time t10) when the calculated differential Td between the value of the hoisting torque T2 and the value of the lowering torque T1 becomes zero, the brake control signal being a signal instructing the brake 24 to release the braking action on the drum 12. The brake 24 switches from the braking state to the released state in accordance with this brake control signal, and releases the braking action on the drum 12.

Subsequently, the hoisting torque T2 generated in the drum 12 falls to a value lower than the lowering torque T1 (time period t10 to t11). Consequently, lowering of the object 102 is started. The lowering speed of the object 102 gradually becomes greater, and the height position of the object 102 gradually decreases. In this case, the lowering torque T1 applied to the drum 12 also decreases, but the rate of decrease thereof is small compared to the rate of decrease in the hoisting torque T2. When the hoisting torque T2 generated in the drum 12 has fallen to a predetermined value, the hoisting torque T2 is maintained uniformly at that predetermined value (time period t11 to t12). In accordance with this, the lowering speed of the object 102 becomes greater at a uniform rate and the height position of the object 102 progressively decreases. In this case, the lowering torque T1 applied to the drum 12 is kept uniformly at a value higher than the hoisting torque T2.

When a certain time has elapsed, at time t12, the hoisting torque T2 generated in the drum 12 increases. Therefore, the object 102 changes from a state of being lowered while accelerating, to a state of being lowered at a uniform speed, and in accordance with this, the lowering torque T1 applied to the drum 12 increases. In this case, the hoisting torque T2 and the lowering torque T1 increase to a value equal to the lowering torque T1 that was applied to the drum 12 while the object 102 was stopped after being hoisted (time period t8 to t10). Thereupon, the hoisting torque T2 and the lowering torque T1 are kept uniformly at this increased value.

When the lever 26*a* is subsequently returned to the neutral position at time t13 (see FIG. 6), in accordance with this, the hoisting torque T2 generated in the drum 12 increases to a value greater than the lowering torque T1. Therefore, the lowering speed of the object 102 starts to decrease and the decrease in the height position of the object 102 becomes more gradual. In this case, the lowering torque T1 applied to the drum 12 also increases. The rate of increase in the lowering torque T1 is smaller than the rate of increase in the hoisting torque T2.

When the hoisting torque T2 generated in the drum 12 at time t14 has increased to a predetermined value, the hoisting torque T2 is kept uniformly at this predetermined value thereafter. In accordance with this, the lowering speed of the object 102 decreases at a uniform rate and the decrease in the height position of the object 102 becomes even more gradual. In this case, the lowering torque T1 applied to the drum 12 is kept uniformly at a value lower than the hoisting torque T2.

At time t15 when a certain time has elapsed from time t14, the hoisting torque T2 generated in the drum 12 decreases. In accordance with this, the decrease in the lowering speed of the object 102 becomes gradual. In this case, the lowering torque T1 applied to the drum 12 also decreases, but the rate of decrease in the lowering torque T1 is small compared to the rate of decrease in the hoisting torque T2. The brake control unit 50 then sends a brake control signal to the brake 24 at the timing (time t16) when the calculated differential Td between the value of the hoisting torque T2 and the value of the lowering torque T1 becomes zero, the brake control signal being a signal instructing the brake 24 to apply a braking action to the drum 12. The brake 24 switches from the released state to the braking state in accordance with this brake control signal, and applies a braking action to the drum 12. Consequently, the drum 12 is held so as not to rotate by the braking force of the brake 24. When this braking action is applied, the lowering speed of the object 102 will have already been reduced to a speed close to zero, and therefore the occurrence of shocks due to the braking action is suppressed. Thereafter, the decrease in the height position of the object 102 is stopped and the object 102 is held at this stopped height position. After time t15, the hoisting torque T2 generated in the drum 12 decreases to zero, whereas the lowering torque T1 applied to the drum 12 is kept at a uniform value due to the load of the object 102.

The operation of the electric winch device according to the present embodiment is performed as described above.

In the present embodiment, the brake control unit 50 causes the brake 24 to release the braking action on the drum 12 at the release timing determined on the basis of the differential Td between the value of the hoisting torque T2 generated in the drum 12 as calculated by the second torque derivation unit 48, and the value of the lowering torque T1 applied to the drum 12 as calculated by the first torque derivation unit 46. Therefore, it is possible to make divergence less liable to occur between the timing at which the braking action on the drum 12 is actually released and the timing at which the electric motor 14 starts rotation of the drum 12, compared to a configuration in which, for example, the trigger for the brake control unit 50 to cause the brake 24 to release the braking action on the drum 12 is operation of the lever 26*a* to the hoisting side or the lowering side from the neutral position. Therefore, it is possible to prevent the occurrence of a slipping-down phenomenon of the object 102 or a pull-up phenomenon of the brake 24, at the start of hoisting or lowering of the object 102.

Furthermore, in the present embodiment, the first torque derivation unit 46 calculates the value of the lowering torque T1 applied to the drum 12 due to the load of the object 102, and the second torque derivation unit 48 calculates the value of the hoisting torque T2 generated in the drum 12 by the driving torque of the electric motor 14, on the basis of the value of the current supplied to the electric motor 14 as measured by the ammeter 34. The brake control unit 50 determines the timing for releasing the braking action of the brake 24 after the lever 26*a* has been operated to the hoisting side or the lowering side from the neutral position, on the basis of the differential between the value of the hoisting torque T2 calculated by the second torque derivation unit 48 and the value of the lowering torque T1 calculated by the first torque derivation unit 46. The brake control unit 50 then causes the brake 24 to release the braking action on the drum 12 by sending a brake control signal instructing the release of braking action, to the brake 24, at the determined timing. Therefore, the operation of releasing the braking action of the brake 24 on the drum 12 can be controlled electrically. Consequently, it is possible to achieve operational control of the brake 24 which corresponds to the electrification of the winch device. Therefore, in the present embodiment, it is possible to prevent the occurrence of a slipping-down phenomenon of the object 102 or a pull-up phenomenon of the brake 24, at the start of hoisting or lowering of the object 102, in an electric winch device.

Furthermore, in the present invention, the brake control unit 50 causes the brake 24 to release the braking action on the drum 12 at a timing at which the differential Td between the value of the hoisting torque T2 calculated by the second torque derivation unit 48 and the value of the lowering torque T1 calculated by the first torque derivation unit 46 decreases to zero after the lever 26*a* has been operated to the hoisting side or the lowering side from the neutral position. Therefore, when starting hoisting or lowering of the object 102, it is possible to release the braking action of the brake 24 on the drum 12 at a timing at which the differential between the hoisting torque T2 generated in the drum 12 and the lowering torque T1 applied to the drum 12 due to the load of the object 102 has been eliminated. Therefore, it is possible to release the braking action on the drum 12 at a timing which reliably avoids the occurrence of a slipping-down phenomenon of the object 102.

Furthermore, in the present embodiment, the brake control unit 50 causes the brake 24 to apply a braking action to the drum 12 by transmitting, to the brake 24, a brake control signal instructing application of a braking action to the drum 12 at a timing at which the absolute value of the differential Td between the value of the hoisting torque T2 calculated by the second torque derivation unit 48 and the value of the lowering torque T1 calculated by the first torque derivation unit 46 decreases to zero from a value greater than zero, after the lever 26*a* has been returned to the neutral position side from the hoisting side or the lowering side. Therefore, when stopping hoisting or lowering of the object 102, it is possible to apply a braking action of the brake 24 to the drum 12 at a timing at which the differential between the hoisting torque T2 generated in the drum 12 and the lowering torque T1 applied to the drum 12 has been eliminated. Consequently, it is possible to prevent sudden stopping of the hoisting or lowering of the object 102 by the brake 24. Furthermore, after the timing at which the differential between the hoisting torque T2 and the lowering torque T1 has been eliminated, it is possible to prevent slipping-down of the object 102 by the braking force of the brake 24, even if the hoisting torque T2 generated in the drum 12 decreases to zero and becomes smaller than the lowering torque T1 applied to the drum 12.

Furthermore, in the present embodiment, the first torque derivation unit 46 calculates the value of the lowering torque T1 on the basis of the value of the tension in the suspension rope 4 detected by the load gauge 32. Therefore, the value of the actual load of the object 102 can be reflected in the control of the brake 24.

The embodiment disclosed here is exemplary in all respects and should not be regarded as restrictive. The scope of the present invention is indicated by the scope of the claims and not by the description given above, and includes all modifications within the same sense and scope as the claims.

For example, in the embodiment described above, the timing at which the brake 24 is caused to release the braking action on the drum 12 is set to the timing at which the differential Td between the value of the hoisting torque T2 calculated by the second torque derivation unit 48 and the value of the lowering torque T1 calculated by the first torque derivation unit 46 has decreased to zero, after the lever 26*a* has been operated to the hoisting side or the lowering side from the neutral position. However, the timing of releasing the braking action on the drum 12 is not necessarily limited to a timing of this kind.

More specifically, the timing at which the brake 24 is caused to release the braking action on the drum 12 may be a timing at which the differential Td between the value of the hoisting torque T2 calculated by the second torque derivation unit 48 and the value of the lowering torque T1 calculated by the first torque derivation unit 46 has decreased to a predetermined first specific value or lower, after the lever 26*a* has been operated to the hoisting side or the lowering side from the neutral position. In this case, the first specific value is desirably set to a value which is greater than zero by a predetermined amount so as to allow a margin such that there is absolutely no possibility of slipping-down of the object 102. According to this configuration, it is possible reliably to prevent the occurrence of a slipping-down phenomenon of the object 102, even when the calculated value of the differential Td does not correspond accurately to the differential between the hoisting torque actually generated in the drum 12 and the lowering torque actually applied to the drum 12, due to the effects of measurement errors, or mechanical vibrations, etc.

Furthermore, in the embodiment described above, the timing at which the brake 24 is caused to apply a braking action to the drum 12 may be a timing at which the differential Td between the value of the hoisting torque T2 calculated by the second torque derivation unit 48 and the value of the lowering torque T1 calculated by the first torque derivation unit 46 has decreased to zero from a value greater than zero, after the lever 26*a* has been returned to the neutral position side from the hoisting side or the lowering side. However, the timing of applying the braking action to the drum 12 is not necessarily limited to a timing of this kind.

More specifically, the timing at which the brake 24 is caused to apply a braking action to the drum 12 may be a timing at which the differential Td between the value of the hoisting torque T2 calculated by the second torque derivation unit 48 and the value of the lowering torque T1 calculated by the first torque derivation unit 46 has decreased to a predetermined second specific value or lower, from a value greater than the second specific value, after the lever 26*a* has been returned to the neutral position side from the hoisting side or the lowering side. In this case, the second specific value is desirably set to a value which is greater than zero by a predetermined amount so as to allow a margin such that there is absolutely no possibility of slipping-down of the object 102 when the hoisting torque T2 occurring in the drum 12 has become zero in accordance with the lever 26*a* being returned to the neutral position side. According to this configuration, it is possible reliably to prevent the occurrence of a slipping-down phenomenon of the object 102, even when the calculated value of the differential Td does not correspond accurately to the differential between the hoisting torque actually generated in the drum 12 and the lowering torque actually applied to the drum 12, due to the effects of measurement errors, or mechanical vibrations, etc.

Furthermore, the brake 24 may be a wet brake, and more specifically, may be a wet disk brake. The wet brake is a brake configured in such a manner that the braking force is changed progressively when switched between the braking state and the released state. Therefore, it is possible to progressively change the braking force of the brake 24 on the drum 12 when the braking action of the brake 24 on the drum 12 is released or when the brake 24 applies a braking action to the drum 12. As a result of this, it is possible to prevent sudden stopping of the hoisting and lowering action of the object 102, and to prevent a slipping-down phenomenon of the object 102 or a momentary sudden drop of the object 102, or jumping of the object 102.

FIG. 7 to FIG. 10 are diagrams which correspond to FIG. 3 to FIG. 6 and show the changes in the operation amount of the lever 26*a*, the lowering torque T1 applied to the drum 12, the hoisting torque T2 generated in the drum 12, the state of the brake 24, the speed of the object 102 in the vertical direction, and the height position of the object 102, with the passage of time, in a modification example which uses a wet brake of this kind as the brake 24.

Figure 7:
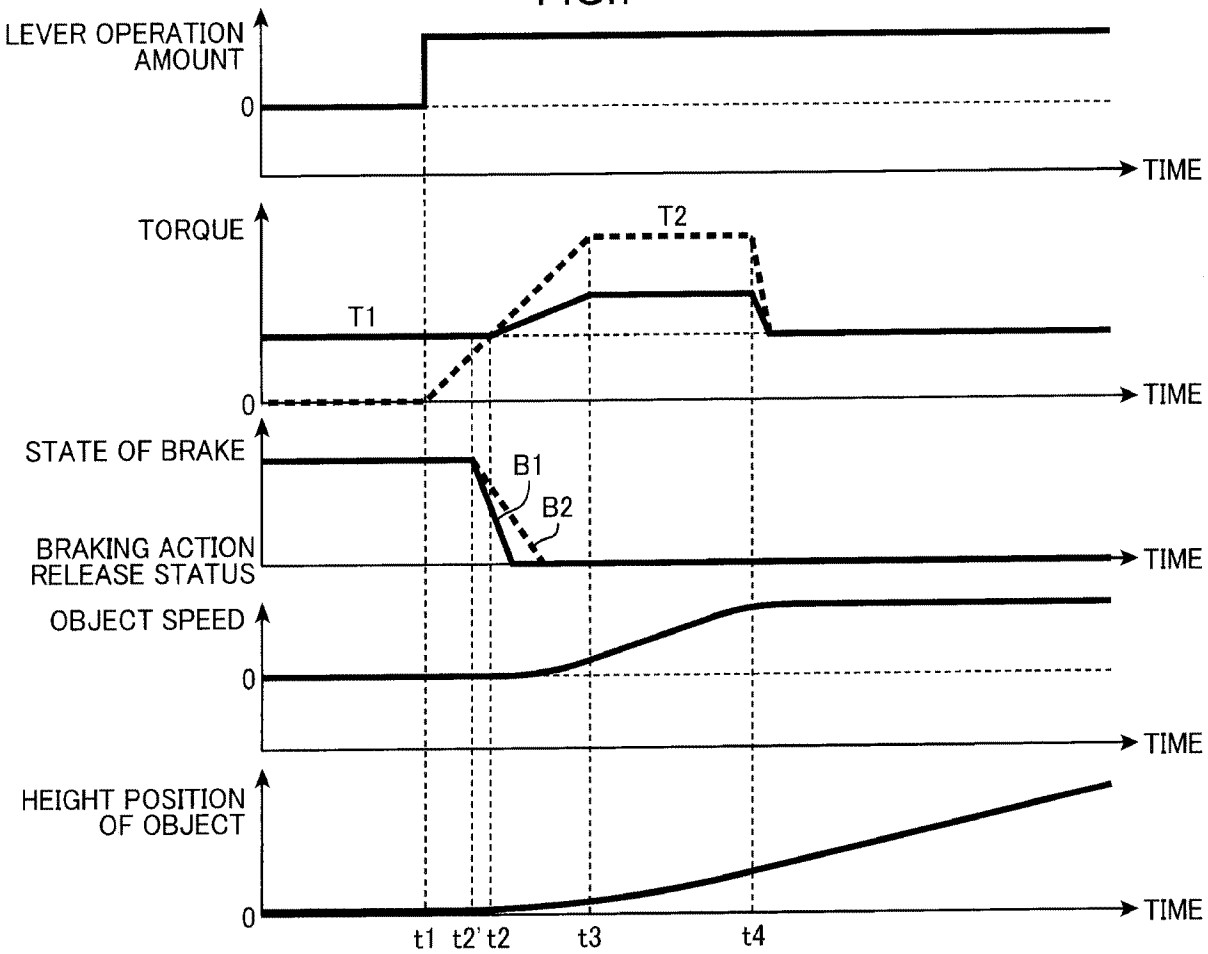
FIG. 7 is a diagram showing change over time in the lever operation amount, the lowering torque and hoisting torque of the drum, the state of the brake, the vertical speed of the object, and the height position of the object, during the course of hoisting an object from a stopped state in the electric winch device according to a modification of the present invention.

In this modification, when the braking action of the brake 24 on the drum 12 is released at time t2' indicated in FIG. 7, during the course of hoisting the object 102 which is in a stopped state, the brake control unit 50 controls the brake 24 in such a manner that the braking force of the brake 24 acting on the drum 12 progressively decreases (see portion B1). In this case, the brake control unit 50 adjusts the braking force of the brake 24 in such a manner that the braking force of the brake 24 decreases at a rate corresponding to the decrease in the calculated value of the differential Td. Furthermore, in the course of this, the brake control unit 50 causes the brake 24 to start release of the braking action on the drum 12, at the timing t2' at which the value of the differential Td decreases to the first specific value or lower, after the lever 26*a* has been operated to the hoisting side from the neutral position.

In this configuration, even after the release of the braking action of the brake 24 has been started, a certain degree of braking force of the brake 24 is still applied to the drum 12. Therefore, it is possible to prevent the occurrence of a slipping-down phenomenon of the object 102, in contrast to cases where the braking force of the brake 24 becomes zero before the hoisting torque T2 generated in the drum 12 becomes greater than the lowering torque T1 applied to the drum 12. Furthermore, in this configuration, the braking force of the brake 24 acting on the drum 12 gradually decreases. Consequently, it is possible reliably to prevent the occurrence of jumping up of the object 102, in contrast with a case where the braking force of the brake decreases to zero suddenly from the braking state. When it is sought to prevent a slipping-down phenomenon and a jumping phenomenon of the object 102 more reliably, the braking force of the brake 24 may be decreased more gradually as indicated by portion B2 in FIG. 7.

Figure 8:
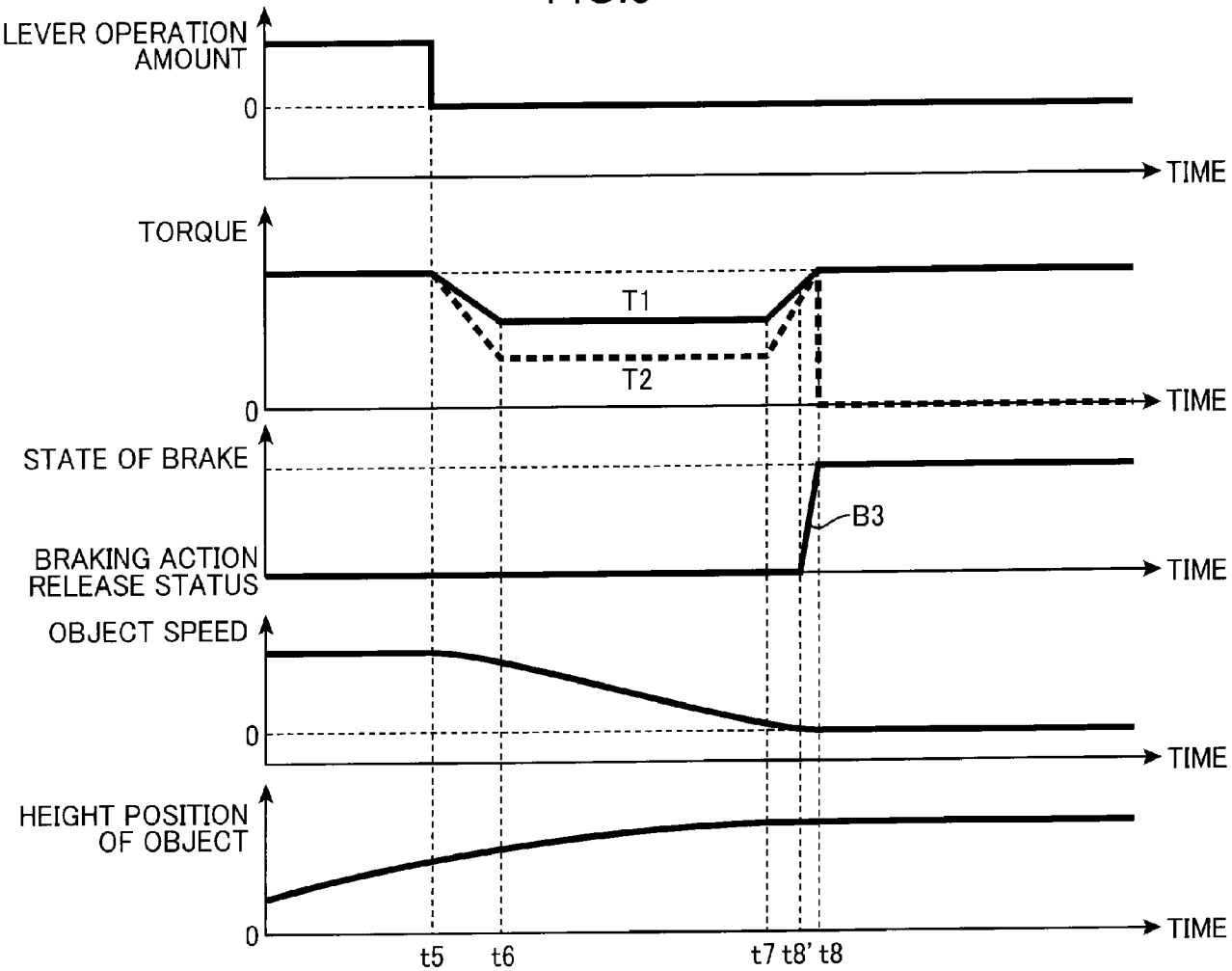
FIG. 8 is a diagram showing change over time in the lever operation amount, the lowering torque and hoisting torque of the drum, the state of the brake, the vertical speed of the object, and the height position of the object, during the course of stopping an object from a state of being hoisted in the electric winch device according to a modification of the present invention.

Furthermore, when a braking action is applied to the drum 12 by the brake 24 at time t8' indicated in FIG. 8, during the course of stopping the object 102 from a state of being hoisted, the brake control unit 50 controls the brake 24 in such a manner that the braking force of the brake 24 acting on the drum 12 progressively increases (see portion B3). In this case, the brake control unit 50 adjusts the braking force of the brake 24 in such a manner that the braking force of the brake 24 increases at a rate corresponding to the decrease in the calculated value of the differential Td. Furthermore, in the course of this, the brake control unit 50 causes the brake 24 to start applying a braking action to the drum 12 at timing t8' at which the value of the differential Td has decreased to the second specific value or lower, from a value greater than the second specific value, after the lever 26*a* has been returned to the neutral position side from the hoisting side and has been situated within a range of play of the lever 26*a*, from the neutral position. In this configuration, it is possible to prevent sudden stopping of the hoisting of the object 102.

Figure 9:
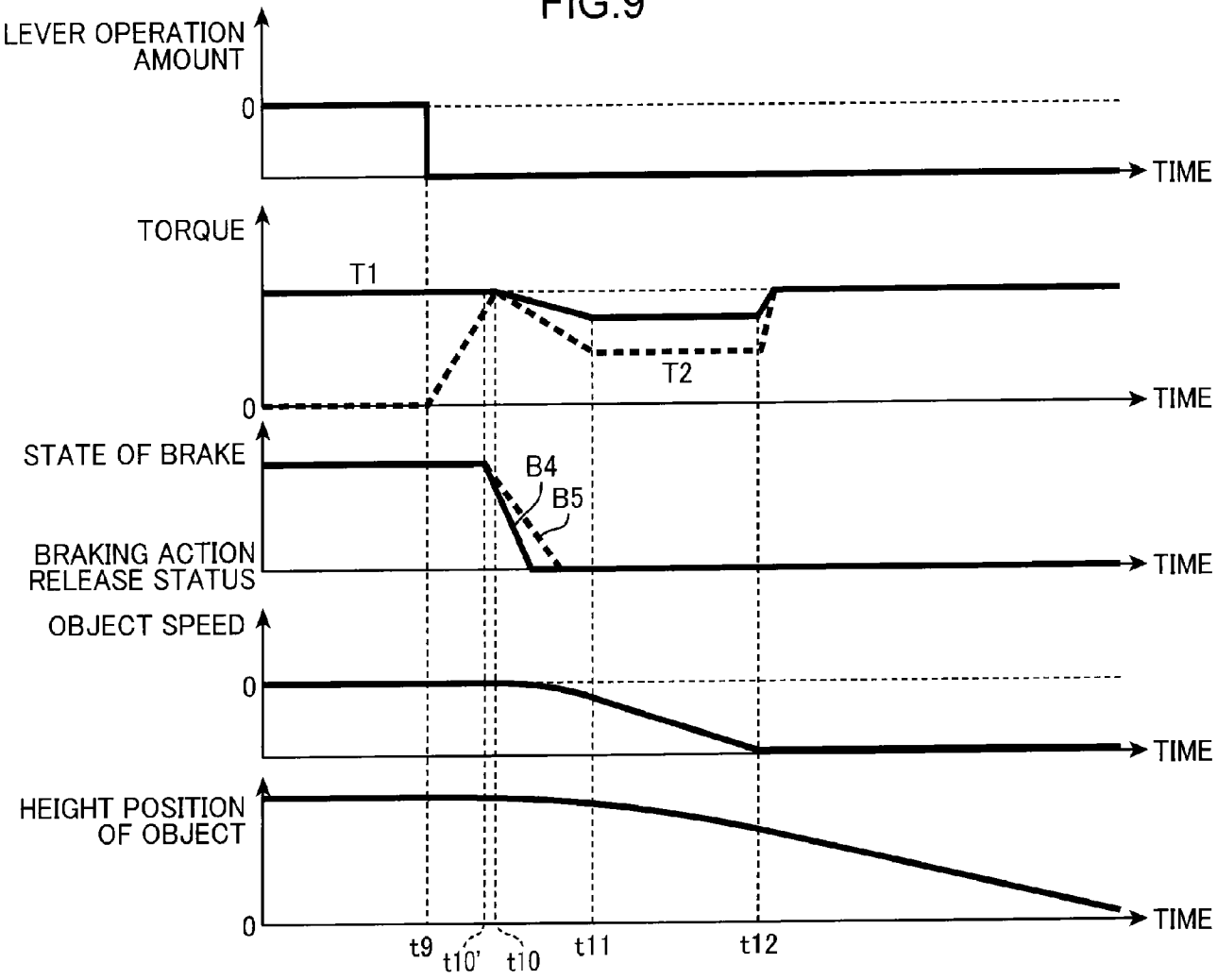
FIG. 9 is a diagram showing change over time in the lever operation amount, the lowering torque and hoisting torque of the drum, the state of the brake, the vertical speed of the object, and the height position of the object, during the course of lowering an object from a stopped state in the electric winch device according to a modification of the present invention.

Furthermore, when the braking action of the brake 24 on the drum 12 is released at time t10' indicated in FIG. 9, during the course of lowering the object 102 which is in a stopped state, the brake control unit 50 controls the brake 24 in such a manner that the braking force of the brake 24 acting on the drum 12 progressively decreases (see portion B4). In this case, the brake control unit 50 adjusts the braking force of the brake 24 in such a manner that the braking force of the brake 24 decreases at a rate corresponding to the decrease in the calculated value of the differential Td. Furthermore, in the course of this, the brake control unit 50 causes the brake 24 to start release of the braking action on the drum 12, at the timing t10' at which the value of the differential Td decreases to the first specific value or lower, after the lever 26*a* has been operated to the lowering side from the neutral position.

In this configuration, even after the release of the braking action of the brake 24 has been started, a certain degree of braking force of the brake 24 is still applied to the drum 12. Therefore, it is possible to prevent the occurrence of sudden momentary falling of the object 102. When seeking to prevent the momentary sudden falling of the object 102 more reliably, the braking force of the brake 24 may be decreased more gradually, as in portion B5.

Figure 10:
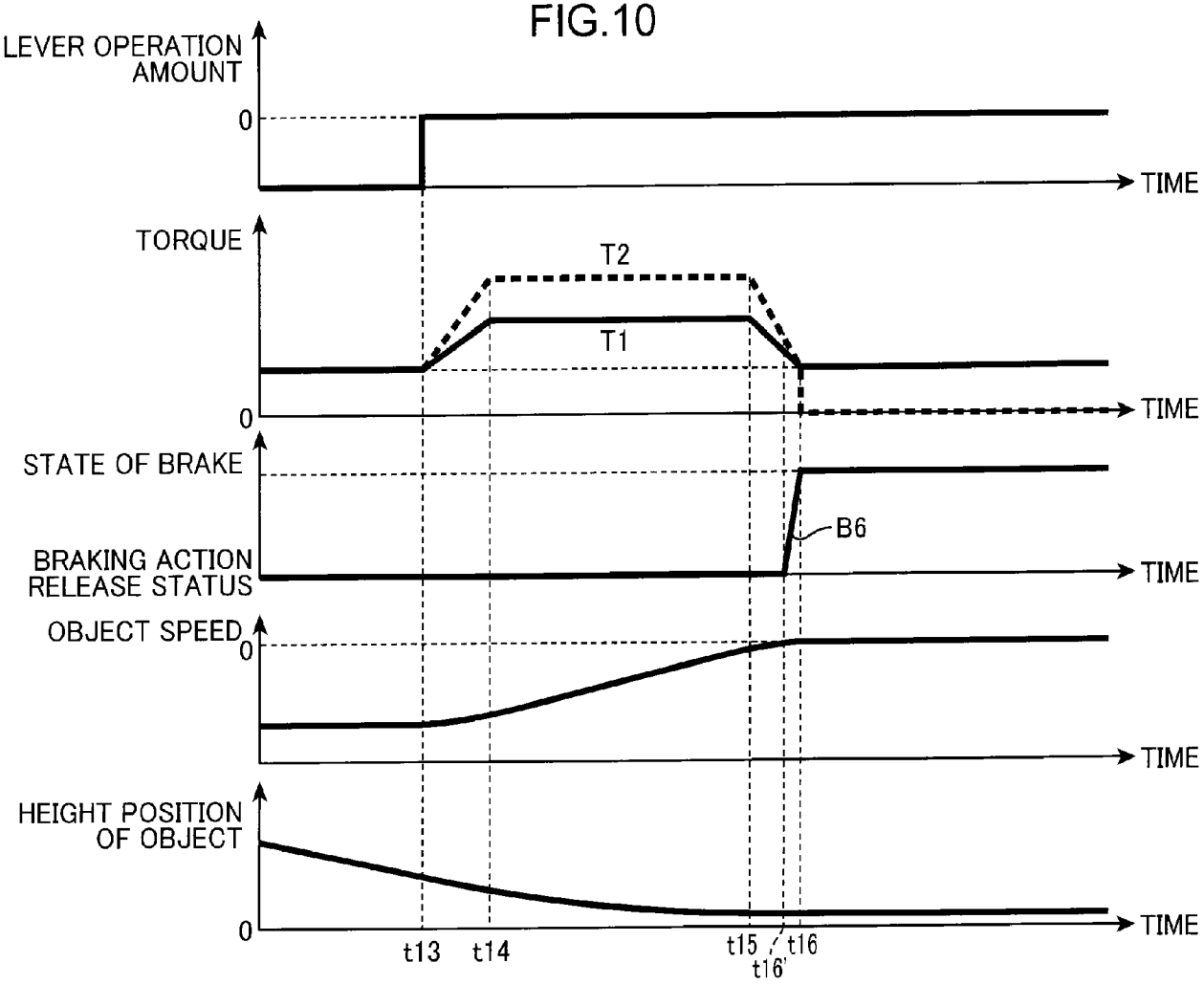
FIG. 10 is a diagram showing change over time in the lever operation amount, the lowering torque and hoisting torque of the drum, the state of the brake, the vertical speed of the object, and the height position of the object, during the course of stopping an object from a state of being lowered in the electric winch device according to a modification of the present invention.

Furthermore, when a braking action is applied to the drum 12 by the brake 24 at time t16' indicated in FIG. 10, during the course of stopping the object 102 from a state of being lowered, the brake control unit 50 controls the brake 24 in such a manner that the braking force of the brake 24 acting on the drum 12 progressively increases (see portion B6). In this case, the brake control unit 50 adjusts the braking force of the brake 24 in such a manner that the braking force of the brake 24 increases at a rate corresponding to the decrease in the calculated value of the differential Td. Furthermore, in the course of this, the brake control unit 50 causes the brake 24 to start applying a braking action to the drum 12 at timing t16' at which the value of the differential Td has decreased to the second specific value or lower, from a value greater than the second specific value, after the lever 26*a* has been returned to the neutral position side from the lowering side and has been situated within a range of play of the lever 26*a*, from the neutral position. In this configuration, it is possible to prevent sudden stopping of the lowering of the object 102.

Furthermore, the value of the hoisting torque T2 generated in the drum 12 may be calculated on the basis of the value of the current supplied to the electric motor 14 as measured by the ammeter 34, when the object 102 is hoisted or lowered at uniform speed. The value of the hoisting torque T2 thus calculated may be used to determine the timing for applying a braking action of the brake 24 to the drum 12, and the timing for releasing the braking action of the brake 24 on the drum 12, rather than using the value of the lowering torque T1 applied to the drum 12 calculated on the basis of the load (tension) applied to the suspension rope 4 as detected by the load gauge 32.

More specifically, when the object 102 is hoisted or lowered at uniform speed, the lowering torque T1 applied to the drum 12 due to the load of the object 102 becomes equal to the hoisting torque T2 generated in the drum 12. Therefore, this value of the hoisting torque T2 can be used instead of the lowering torque T1 as a reference for determining the timing for applying a braking action of the brake 24 to the drum 12, and the timing for releasing the braking action of the brake 24 on the drum 12. When hoisting and lowering of the object 102 is first carried out, the object 102 should not be hoisted and lowered at uniform speed when determining the timing at which the braking action of the brake 24 is first to be released. Therefore, the value of the lowering torque T1 applied to the drum 12 calculated on the basis of the load applied to the suspension rope 4 as detected by the load gauge 32 is used to determine the timing in this case. The value of the hoisting torque T2 generated in the drum 12 calculated during subsequent hoisting or lowering of the object 102 at uniform speed is then stored in a memory (not illustrated). The timing for applying the braking action of the brake 24 to the drum 12, and the timing for releasing the braking action of the brake 24 on the drum 12, during subsequent operation of the electric winch device, is determined by using the value of the torque stored in the memory as the value of the lowering torque T1 applied to the drum 12 due to the load of the object 102.

According to this configuration, it is possible to determine the value of the lowering torque T1 applied to the drum 12 due to the load of the object 102, with better accuracy than when determining same on the basis of the detection value of the load gauge 32.

Furthermore, in the embodiment given above, a winch device for a suspended load in which a suspended load 100 and a hook device 6 are treated as an integrated body forming an object 102 of hoisting and lowering, is described as one example of the electric winch device according to the present invention. However, the electric winch device of the present invention is not necessarily limited to a winch device for a suspended load of this kind. For instance, the electric winch device of the present invention may be a derrick winch device for performing a derricking action of a derricking member, such as a boom, which is provided on a crane. The configuration of the present invention can also be applied similarly to a derricking winch device of this kind. In this case, the object is an integrated object constituted by the derricking member, the hook device suspended from the derricking member, and the suspended load.

SUMMARY OF THE EMBODIMENTS

A summary of the embodiments is given below.

The electric winch device according to the embodiment described above is an electric winch device provided on a crane, the electric winch device including: an electric motor; a winch drum which rotates so as to hoist or lower an object by being driven by the electric motor; a brake which brakes the rotation of the winch drum; an operation lever which is capable of being operated from a neutral position to a hoisting side and to a lowering side, the hoisting side being one side for instructing hoisting of the object, the lowering side being the other side for instructing lowering of the object, an ammeter which measures a value of a current supplied to the electric motor; and a controller which controls the operation of the electric motor so that the winch drum rotates in accordance with the operation of the operation lever, and also controls the operation of the brake, wherein the controller includes: a first torque derivation unit which derives a value of a first torque applied to the winch drum due to the load of the object; a second torque derivation unit which derives a value of a second torque on the basis of the current value measured by the ammeter, the second torque being a torque generated in the winch drum in the direction of rotation for hoisting the object by a drive torque of the electric motor; and a brake control unit which determines a timing for releasing a braking action on the winch drum after the operation lever has been operated to the hoisting side or the lowering side from the neutral position, on the basis of a differential between the second torque value derived by the second torque derivation unit and the first torque value derived by the first torque derivation unit, and which causes the brake to release the braking action on the winch drum by transmitting, to the brake, a control signal instructing release of the braking action on the winch drum at the determined timing.

In this electric winch device, the brake control unit determines the timing for releasing the braking action of the winch drum after the operation lever has been operated to the hoisting side or the lowering side from the neutral position, on the basis of the differential between the second torque value generated in the winch drum and derived by the second torque derivation unit, and the first torque value applied to the winch drum and derived by the first torque derivation unit, and the brake control unit causes the brake to release the braking action on the winch drum at the determined release timing. Therefore, it is possible to make divergence less liable to occur between the timing at which the braking action on the winch drum is actually released and the timing at which the electric motor starts rotation of the winch drum, compared to a case in which, for example, the trigger for the brake control unit to cause the brake to release the braking action on the winch drum is operation of the operation lever to the hoisting side or the lowering side from the neutral position. Therefore, it is possible to prevent the occurrence of a slipping-down phenomenon of the object or a pull-up phenomenon of the brake, at the start of hoisting or lowering of the object. Moreover, in this electric winch device, the first torque derivation unit derives the value of the first torque applied to the winch drum due to the load of the object, and the second torque derivation unit derives the value of the second torque generated in the winch drum in the direction of rotation for hoisting the object by the drive torque of the electric motor, on the basis of the current value measured by the ammeter. The brake control unit then causes the braking action on the winch drum to be released by transmitting, to the brake, a control signal instructing the release of the braking action, at a timing determined on the basis of the differential between the second torque value derived by the second torque derivation unit and the first torque value derived by the first torque derivation unit, after the operation lever has been operated to the hoisting side or the lowering side from the neutral position. Therefore, the operation of releasing the braking action of the brake on the winch drum can be controlled electrically. Consequently, it is possible to achieve operational control of the brake which corresponds to the electrification of the winch device. Therefore, it is possible to prevent the occurrence of a slipping-down phenomenon of the object or a pull-up phenomenon of the brake, at the start of hoisting or lowering of the object, in an electric winch device.

In the electric winch device described above, desirably, the brake control unit determines, as the timing for releasing the braking action on the winch drum, a timing at which the differential between the second torque value derived by the second torque derivation unit and the first torque value derived by the first torque derivation unit has decreased to a predetermined first specific value or lower, after the operation lever has been operated to the hoisting side or the lowering side from the neutral position.

According to this configuration, at the start of hoisting or lowering of the object, the braking action of the brake on the winch drum is released at a timing at which the differential between the second torque generated in the winch drum and the first torque applied to the winch drum due to the load of the object has become sufficiently small. Therefore, it is possible to release the braking action on the winch drum at a timing which reliably avoids the occurrence of a slipping-down phenomenon of the object.

In the electric winch device described above, desirably, the brake control unit causes the brake to apply the braking action to the winch drum by transmitting, to the brake, a control signal instructing application of the braking action to the winch drum, at a timing at which the differential between the second torque value derived by the second torque derivation unit and the first torque value derived by the first torque derivation unit has decreased to a predetermined second specific value or lower from a value greater than the second specific value, after the operation lever has been operated so as to return to the neutral position side from the hoisting side or the lowering side.

According to this configuration, when the operation lever is returned to the neutral position and the hoisting or lowering of the object is stopped, a braking action of the brake on the winch drum is applied at a timing at which the differential between the second torque generated in the winch drum and the first torque applied to the winch drum due to the load of the object has become sufficiently small. Consequently, it is possible to prevent sudden stopping of the hoisting or lowering of the object. Furthermore, even if the second torque generated in the winch drum deceases to zero and becomes smaller than the first torque applied to the winch drum, after the timing at which the differential between the second torque and the first torque has become sufficiently small, then it is still possible reliably to prevent slipping-down of the object by the braking force of the brake.

The electric winch device described above may further include a load gauge which detects a value of an external force applied to the winch drum due to the load of the object, and the first torque derivation unit may derive the first torque value on the basis of the external force value detected by the load gauge.

According to this configuration, the value of the actual load of the object can be reflected in the control of the brake.

In the electric winch device described above, desirably, the brake is a wet brake.

The wet brake is a brake configured in such a manner that the braking force is changed progressively when switched between a braking state and a released state. Therefore, according to this configuration, it is possible to progressively change the braking force of the brake on the winch drum when the braking action of the brake on the winch drum is released or when the brake applies a braking action to the drum. As a result of this, it is possible to prevent sudden stopping of the hoisting and lowering of the object, and the occurrence of a slipping-down phenomenon of the object, momentary sudden dropping, a jumping phenomenon, or the like.

According to the embodiments described above, it is possible to prevent the occurrence of a slipping-down phenomenon of the object or a pull-up phenomenon of the brake, at the start of hoisting or lowering of the object, in an electric winch device.

The invention claimed is:

1. An electric winch device provided on a crane, the electric winch device comprising:

an electric motor;

a winch drum which rotates so as to hoist or lower an object by being driven by the electric motor;

a brake which brakes the rotation of the winch drum;

an operation lever which is capable of being operated from a neutral position to a hoisting side and to a lowering side, the hoisting side being one side for instructing hoisting of the object, the lowering side being the other side for instructing lowering of the object;

an ammeter which measures a value of a current supplied to the electric motor; and a controller which controls the operation of the electric motor so that the winch drum rotates in accordance with the operation of the operation lever, and also controls the operation of the brake, wherein the controller includes:

a first torque derivation unit which derives a value of a first torque applied to the winch drum due to the load of the object;

a second torque derivation unit which derives a value of a second torque on the basis of the current value measured by the ammeter, the second torque being a torque generated in the winch drum in the direction of rotation for hoisting the object by a drive torque of the electric motor; and a brake control unit which continuously determines a differential between the first torque value and the second torque value, and determines a timing for releasing a braking action on the winch drum after the operation lever has been operated to the hoisting side or the lowering side from the neutral position, on the basis of the differential between the second torque value derived by the second torque derivation unit and the first torque value derived by the first torque derivation unit, and which causes the brake to release the braking action on the winch drum by transmitting, to the brake, a control signal instructing release of the braking action on the winch drum at the determined timing, wherein the brake control unit causes the brake to apply the braking action to the winch drum by transmitting, to the brake, a control signal instructing application of the braking action to the winch drum, at a timing at which the continuously determined differential between the second torque value derived by the second torque derivation unit and the first torque value derived by the first torque derivation unit has decreased to a predetermined second specific value or lower from a value greater than the second specific value, after the operation lever has been operated so as to return to the neutral position from the hoisting side or the lowering side.

2. An electric winch device provided on a crane, the electric winch device comprising:

an electric motor;

a winch drum which rotates so as to hoist or lower an object by being driven by the electric motor;

a brake which brakes the rotation of the winch drum;

an operation lever which is capable of being operated from a neutral position to a hoisting side and to a lowering side, the hoisting side being one side for instructing hoisting of the object, the lowering side being the other side for instructing lowering of the object;

an ammeter which measures a value of a current supplied to the electric motor; and a controller which controls the operation of the electric motor so that the winch drum rotates in accordance with the operation of the operation lever, and also controls the operation of the brake, wherein the controller includes:

a first torque derivation unit which derives a value of a first torque applied to the winch drum due to the load of the object;

a second torque derivation unit which derives a value of a second torque on the basis of the current value measured by the ammeter, the second torque being a torque generated in the winch drum in the direction of rotation for hoisting the object by a drive torque of the electric motor; and a brake control unit which determines a timing for releasing a braking action on the winch drum after the operation lever has been operated to the hoisting side or the lowering side from the neutral position, on the basis of the differential between the second torque value derived by the second torque derivation unit and the first torque value derived by the first torque derivation unit, and which causes the brake to release the braking action on the winch drum by transmitting, to the brake, a control signal instructing release of the braking action on the winch drum at the determined timing, wherein the brake control unit causes the brake to apply the braking action to the winch drum by transmitting, to the brake, a control signal instructing application of the braking action to the winch drum, at a timing at which the differential between the second torque value derived by the second torque derivation unit and the first torque value derived by the first torque derivation unit has decreased to a predetermined second specific value or lower from a value greater than the second specific value, after the operation lever has been operated so as to return to the neutral position from the hoisting side or the lowering side, and the second specific value is set to a value which is greater than zero by a predetermined amount.

3. The electric winch device according to claim 2, wherein the brake control unit determines, as the timing for releasing the braking action on the winch drum, a timing at which the differential between the second torque value derived by the second torque derivation unit and the first torque value derived by the first torque derivation unit has decreased to a predetermined first specific value or lower, after the operation lever has been operated to the hoisting side or the lowering side from the neutral position.

4. The electric winch device according to claim 2, further comprising a load gauge which detects a value of an external force applied to the winch drum due to the load of the object, wherein the first torque derivation unit derives the first torque value on the basis of the external force value detected by the load gauge.

5. The electric winch device according to claim 2, wherein the brake is a wet brake.

* * * * *